US010633994B2

(12) United States Patent
Barker

(10) Patent No.: US 10,633,994 B2
(45) Date of Patent: Apr. 28, 2020

(54) FEATHER SEAL ASSEMBLY

(71) Applicant: UNITED TECHNOLOGIES CORPORATION, Farmington, CT (US)

(72) Inventor: William M. Barker, North Andover, MA (US)

(73) Assignee: United Technologies Corporation, Farmington, CT (US)

( * ) Notice: Subject to any disclaimer, the term of this patent is extended or adjusted under 35 U.S.C. 154(b) by 105 days.

(21) Appl. No.: 15/927,145

(22) Filed: Mar. 21, 2018

(65) Prior Publication Data

US 2019/0292927 A1 Sep. 26, 2019

(51) Int. Cl.

| | |
|---|---|
| ***F01D 11/00*** | (2006.01) |
| ***F01D 11/08*** | (2006.01) |
| ***F01D 25/24*** | (2006.01) |

(52) U.S. Cl.

CPC ..... *F01D 11/005* (2013.01); *F01D 11/003* (2013.01); *F01D 11/08* (2013.01); *F01D 25/24* (2013.01); *F05D 2220/32* (2013.01); *F05D 2240/11* (2013.01); *F05D 2240/55* (2013.01); *F05D 2240/57* (2013.01); *F05D 2250/75* (2013.01)

(58) Field of Classification Search

CPC ..... F01D 11/005; F01D 11/08; F01D 25/24; F01D 11/00; F01D 11/003; F05D 2220/32; F05D 2240/11; F05D 2240/55; F05D 2250/75; F05D 2240/57

See application file for complete search history.

(56) References Cited

U.S. PATENT DOCUMENTS

| | | | | |
|---|---|---|---|---|
| 4,477,086 | A * | 10/1984 | Feder | F01D 11/005 277/632 |
| 4,749,333 | A | 6/1988 | Bonner et al. | |
| 5,988,975 | A | 11/1999 | Pizzi | |
| 7,600,967 | B2 * | 10/2009 | Pezzetti, Jr. | F01D 11/005 415/115 |
| 8,534,675 | B2 | 9/2013 | Heinz-Schwarzmaier et al. | |
| 8,641,371 | B2 * | 2/2014 | Nakamura | F01D 11/18 415/139 |

(Continued)

FOREIGN PATENT DOCUMENTS

| | | |
|---|---|---|
| EP | 2213841 A1 | 8/2010 |
| WO | 9930009 A1 | 6/1999 |

OTHER PUBLICATIONS

European Search Report for European Application No. 19164118.2, dated Jun. 4, 2019.

*Primary Examiner* — Richard A Edgar
*Assistant Examiner* — Joshua R Beebe
(74) *Attorney, Agent, or Firm* — Carlson, Gaskey & Olds, P.C.

(57) ABSTRACT

A seal assembly for a gas turbine engine according to an example of the present disclosure includes a seal segment. The seal segment includes a blade-sealing portion that provides an elongated slot, a flange that extends from the blade-sealing portion, and a hook that extends from the blade-sealing portion and is spaced from the flange. The hook has a surface that at least partially provides a cavity. A feather seal has an elongated portion and first and second legs which extend from the elongated portion. The first leg abuts the flange, the second leg is disposed in the cavity, and the elongated portion is disposed in the elongated slot.

20 Claims, 6 Drawing Sheets

A

(56) References Cited

U.S. PATENT DOCUMENTS

| | | | | |
|---|---|---|---|---|
| 2005/0152777 | A1 | 7/2005 | Thompson | |
| 2005/0232752 | A1* | 10/2005 | Meisels | F01D 25/24 415/116 |
| 2007/0025837 | A1 | 2/2007 | Pezzetti, Jr. et al. | |
| 2007/0104571 | A1* | 5/2007 | Drerup | F01D 11/005 415/191 |
| 2010/0187762 | A1* | 7/2010 | Heinz-Schwarzmaier | F01D 11/005 277/312 |
| 2012/0189424 | A1* | 7/2012 | Propheter-Hinckley | F01D 11/005 415/1 |
| 2015/0377050 | A1 | 12/2015 | Freeman et al. | |
| 2016/0312634 | A1* | 10/2016 | Davis | F16J 15/002 |

* cited by examiner

FEATHER SEAL ASSEMBLY

STATEMENT REGARDING FEDERALLY SPONSORED RESEARCH OR DEVELOPMENT

This invention was made with Government support under W58RGZ-16-C-0046 awarded by the United States Army. The Government has certain rights in this invention.

BACKGROUND

A gas turbine engine typically includes at least a compressor section, a combustor section and a turbine section. The compressor section pressurizes air into the combustion section where the air is mixed with fuel and ignited to generate an exhaust gas flow. The exhaust gas flow expands through the turbine section to drive the compressor section and, if the engine is designed for propulsion, a fan section.

The turbine section may include multiple stages of rotatable blades and static vanes. An annular shroud may be provided around the blades in close radial proximity to the tips of the blades to reduce the amount of gas flow that escapes around the blades. The shroud typically includes a plurality of segments that are circumferentially arranged. Feather seals may be received in adjacent segments to seal the gaps between adjacent segments.

SUMMARY

A seal assembly for a gas turbine engine according to an example of the present disclosure includes a seal segment. The seal segment includes a blade-sealing portion that provides an elongated slot, a flange that extends from the blade sealing portion, and a hook that extends from the blade sealing portion and is spaced from the flange. The hook has a surface that at least partially provides a cavity. A feather seal has an elongated portion and first and second legs which extend from the elongated portion. The first leg abuts the flange, the second leg is disposed in the cavity, and the elongated portion is disposed in the elongated slot.

In a further embodiment according to any of the foregoing embodiments, the feather seal has a goalpost shaped cross section.

In a further embodiment according to any of the foregoing embodiments, the seal assembly includes a middle feather seal. The hook provides a hook slot which extends from the elongated slot, and the middle feather seal is received in the hook slot.

In a further embodiment according to any of the foregoing embodiments, an end of the middle feather seal abuts the elongated portion.

In a further embodiment according to any of the foregoing embodiments, the hook is a first hook, and the seal segment includes a second hook that is spaced from the first hook and at least partially provides the cavity.

In a further embodiment according to any of the foregoing embodiments, the first hook provides a first hook slot which extends from the elongated slot, and the second hook provides a second hook slot which extends from the elongated slot.

In a further embodiment according to any of the foregoing embodiments, the distance between the first and second legs is different from the distance between the first hook slot and the second hook slot.

In a further embodiment according to any of the foregoing embodiments, the distance between the first and second legs is less than the distance between the first hook slot and the second hook slot.

In a further embodiment according to any of the foregoing embodiments, the seal assembly includes a middle feather seal received in the first hook slot and an L-shaped feather seal received in the second hook slot and the elongated slot.

In a further embodiment according to any of the foregoing embodiments, the seal assembly includes gasket received against the first leg.

A gas turbine engine according to an example of the present disclosure includes a turbine section positioned about an engine central longitudinal axis and a seal assembly of the turbine section. The seal assembly includes a seal segment including a blade-sealing portion which provides an axially elongated slot with respect to the engine central longitudinal axis. A flange extends radially outward from the blade-sealing portion. A hook extends radially outward from the blade-sealing portion and axially aft of the flange, and the hook has a surface that at least partially provides a cavity. A feather seal has an elongated portion and first and second legs which extend from the elongated portion. The first leg abuts the flange, the second leg is disposed in the cavity, and the elongated portion is disposed in the elongated slot.

In a further embodiment according to any of the foregoing embodiments, the hook is a first hook, and the seal segment includes a second hook axially aft of the first hook and at least partially provides the cavity.

In a further embodiment according to any of the foregoing embodiments, the first hook provides a first hook slot which extends radially outward from the elongated slot, and the second hook provides a second hook slot which extends radially outward from the elongated slot.

In a further embodiment according to any of the foregoing embodiments, the axial distance between the first and second legs is different from the axial distance between the first hook slot and the second hook slot.

In a further embodiment according to any of the foregoing embodiments, the axial distance between the first and second legs is less than the axial distance between the first hook slot and the second hook slot.

In a further embodiment according to any of the foregoing embodiments, a middle feather seal is received in the first hook slot and an L-shaped feather seal which is received in the second hook slot and the elongated slot.

In a further embodiment according to any of the foregoing embodiments, the gas turbine engine includes a rotor section. The seal assembly is positioned radially outward of and axially aligned with the rotor section and a stator section is axially spaced from the rotor section.

In a further embodiment according to any of the foregoing embodiments, a a gasket is received against a forward surface of the flange and a forward surface of the first leg.

In a further embodiment according to any of the foregoing embodiments, the stator section includes a stator rail, and the gasket is received between the stator rail and the flange.

A method of assembling a seal assembly for a gas turbine engine, according to an example of the present disclosure includes providing a plurality of circumferentially spaced seal segments radially outward of a rotor with respect to an engine centerline axis. Each seal includes a blade-sealing portion which provides an elongated slot, a flange which extends from the blade-sealing portion, and a first hook which extends from the blade-sealing portion and spaced from the flange. The hook has a surface that at least partially provides a cavity. A feather seal assembly is inserted into circumferentially adjacent ones of the plurality of seal segments. The feather seal assembly includes a feather seal which has an elongated portion and first and second legs which extend from the elongated portion. The first leg abuts the flange of each of the adjacent ones of the plurality of seal segments. The second leg is disposed in the cavity of each of the adjacent ones of the plurality of seal segments, and the elongated portion is disposed in the elongated slot of each of the adjacent ones of the plurality of seal segments.

DETAILED DESCRIPTION

Figure 1:
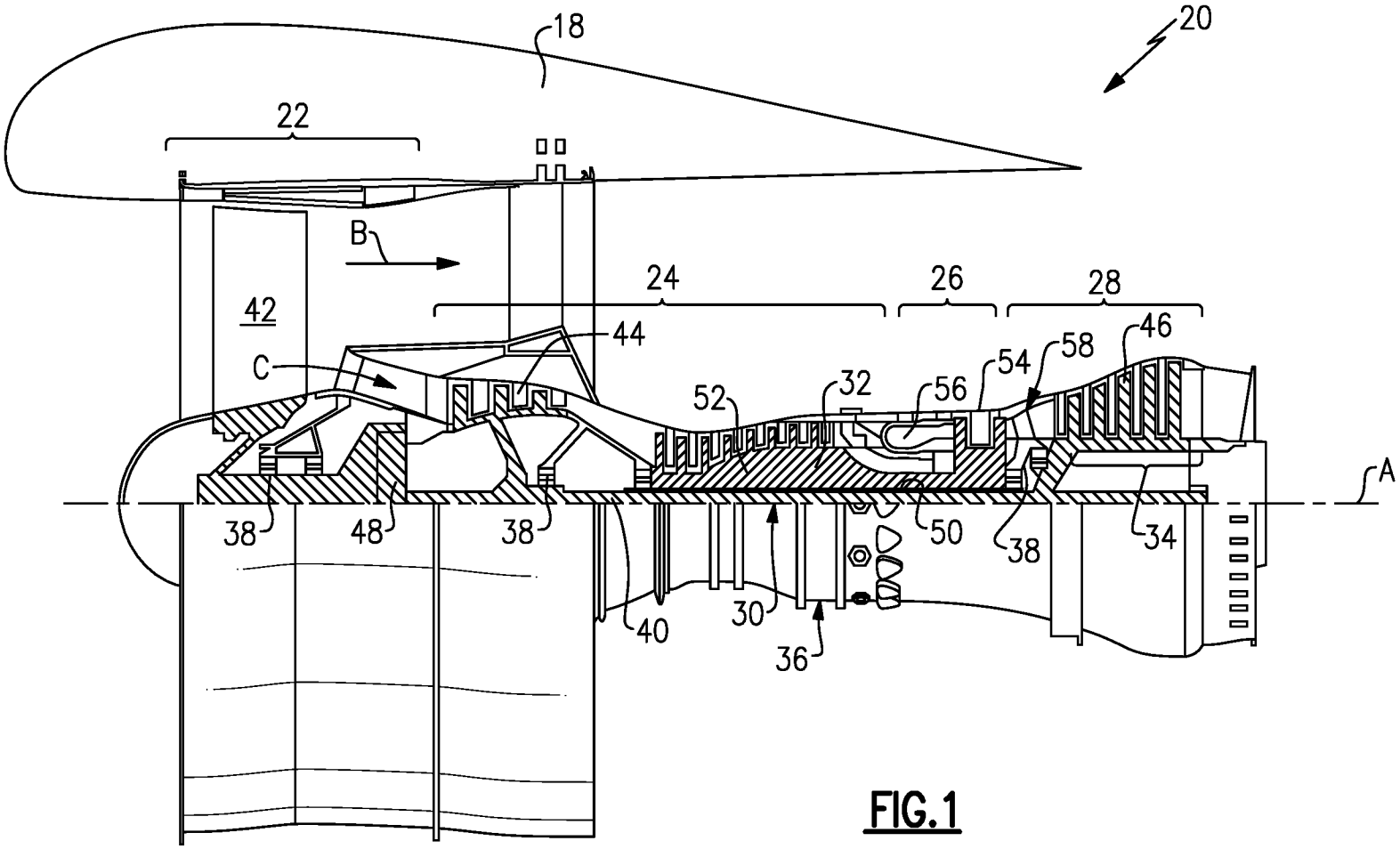
FIG. 1 schematically illustrates a gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. The fan section 22 drives air along a bypass flow path B in a bypass duct defined within a nacelle 18, and also drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects a fan 42, a first (or low) pressure compressor 44 and a first (or low) pressure turbine 46. The inner shaft 40 is connected to the fan 42 through a speed change mechanism, which in exemplary gas turbine engine 20 is illustrated as a geared architecture 48 to drive the fan 42 at a lower speed than the low speed spool 30. The high speed spool 32 includes an outer shaft 50 that interconnects a second (or high) pressure compressor 52 and a second (or high) pressure turbine 54. A combustor 56 is arranged in exemplary gas turbine 20 between the high pressure compressor 52 and the high pressure turbine 54. A mid-turbine frame 57 of the engine static structure 36 is arranged generally between the high pressure turbine 54 and the low pressure turbine 46. The mid-turbine frame 57 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The mid-turbine frame 57 includes airfoils 59 which are in the core airflow path C. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of combustor section 26 or even aft of turbine section 28, and fan section 22 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five 5:1. Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1. It should be understood, however, that the above parameters are only exemplary of one embodiment of a geared architecture engine and that the present invention is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet (10,668 meters). The flight condition of 0.8 Mach and 35,000 ft (10,668 meters), with the engine at its best fuel consumption—also known as "bucket cruise Thrust Specific Fuel Consumption ('TSFC)"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction read [(Tram ° R)/(518.7° R)]^0.5. The "Low corrected fan tip speed" as disclosed herein according to one non-limiting embodiment is less than about 1150 ft/second (350.5 meters/second).

Figure 2:
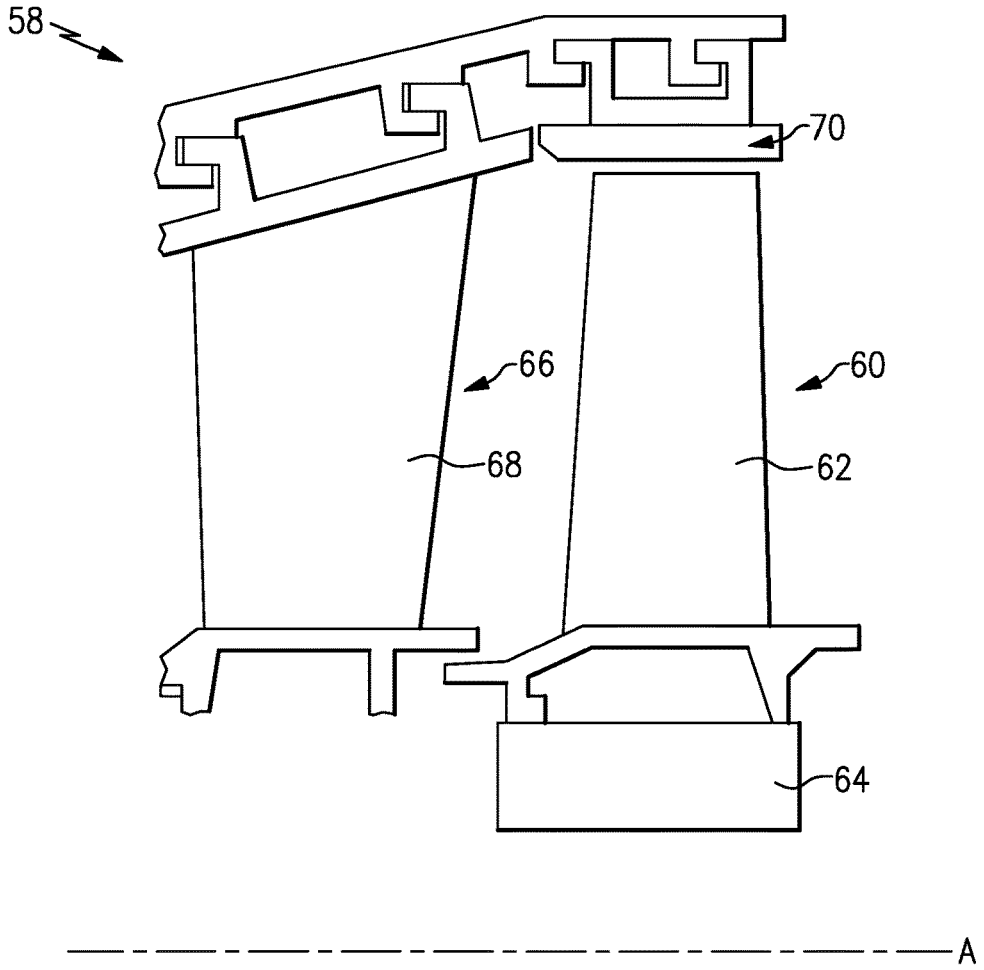
FIG. 2 schematically illustrates an example section of a gas turbine engine.

FIG. 2 schematically illustrates a section 58 of a gas turbine engine, the example being a portion of the low pressure turbine 46 of the engine 20. Other sections, including compressor or high pressure turbine sections, may benefit from this disclosure. The section 58 includes a rotor section 60 having rotor blades 62 extending radially outward from a rotor 64 with respect to the engine central longitudinal axis A. The rotor section 60 is axially spaced from a stator section 66 having vanes 68 positioned circumferentially about the engine central longitudinal axis A. A blade outer air seal assembly 70 is positioned radially outward of and axially aligned with the blades 62. The seal assembly 70 extends circumferentially about the engine central longitudinal axis A.

Figure 3:
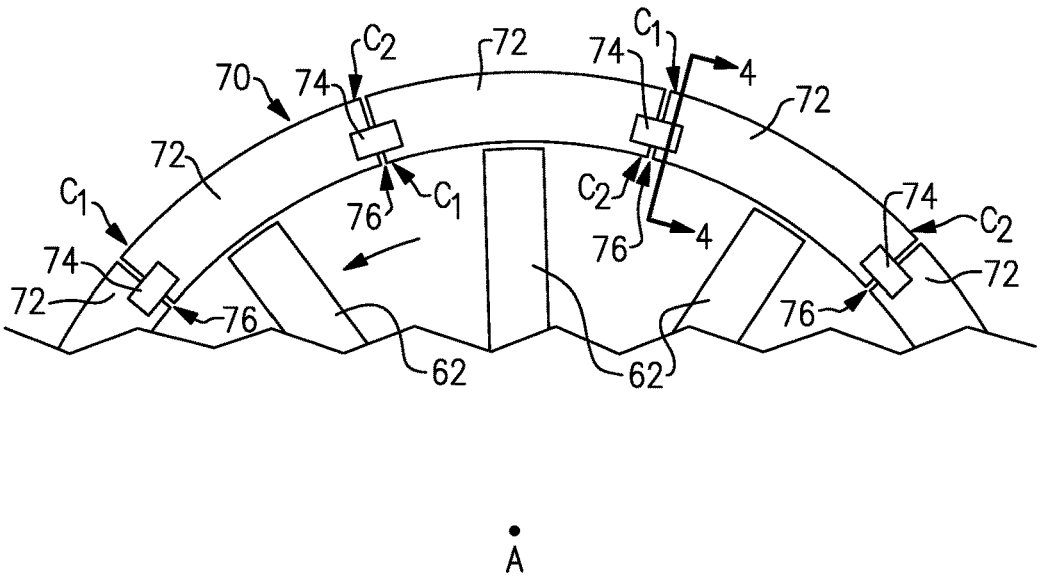
FIG. 3 schematically illustrates an example seal assembly.

FIG. 3 schematically illustrates a portion of the example seal assembly 70 arranged radially outward of rotor blades 62. The seal assembly 70 includes circumferentially spaced segments 72 forming an annulus about the engine central longitudinal axis A radially outward of the blades 62. A feather seal assembly 74 is received in adjacent segments 72 to seal each circumferential gap 76 between circumferential ends C1 and C2 of adjacent segments 72.

Figure 4:
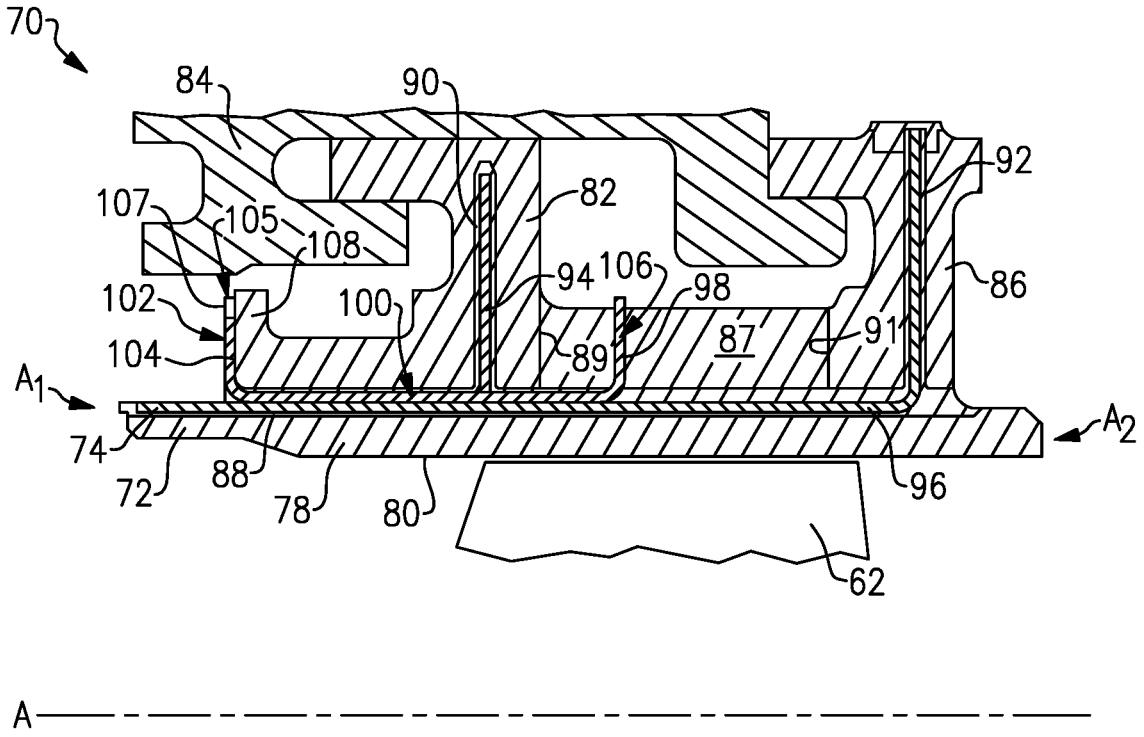
FIG. 4 illustrates a cross sectional view of the example seal assembly.

FIG. 4 illustrates a cross sectional view of the example seal assembly 70 with respect to the cutting plane shown in FIG. 3. The segment 72 includes a blade-sealing portion 78 extending from the first axial end A1 to the second axial end A2 of the segment 72 and having a radially inner free surface 80 adjacent the tip of the rotor blade 62. In one example, the surface 80 is in close radial proximity to the tip of the blade 62 to reduce the amount of gas flow that escapes over the tip of the blade 62. A first hook 82 extends radially outward of the blade-sealing portion 78 and is for attachment to a seal support 84. A second hook 86 is axially aft of the first hook 82 and extends radially outward of the blade-sealing portion 78 for attachment to the support 84. The first hook 82 and the second hook 86 provide a central cavity 87 axially therebetween. The cavity is provided at least partially by the aft surface 89 of the hook 82 and the forward surface 91 of the hook 86. The blade-sealing portion 78 has an axially elongated slot 88 that extends substantially from the axial end A1 to the axial end A2 of the segment 72. The hook 82 has a slot 90 extending radially outward from the slot 88, and the hook 86 has a slot 92 extending radially outward from the slot 88. The feather seal assembly 74 is received in the slots 88, 90, 92. The slots 88, 90, and 92 are interconnected.

The example feather seal assembly 74 has three distinct pieces, including a middle feather seal 94, an L-shaped feather seal 96, and goalpost feather seal 98. Each feather seal 94, 96, 98 may be a thin sheet, and, in some examples, the feather seals are metal or metal alloys. The middle feather seal 94 is elongated in the radial direction and received within the slot 90. The L-shaped feather seal 96 is received within the slot 88 and the slot 92. The goalpost feather seal 98 includes a portion 100 received within the slot 88, and first and second legs 102, 106 extending from the body portion 100. The goalpost feather seal 98 has a goalpost cross-section, in that substantially parallel legs extend in the same direction from opposite ends of the body portion 100. The first leg 102 is received against a forward surface 104 of a flange 108 extending from the blade-sealing portion 78. The second leg 106 is received within the central cavity 87. The example slot 88 extends at least from the surface 104 to the slot 92. Portions of both the goalpost feather seal 98 and the L-shaped feather seal 96 are received in the slot 88.

Figure 5:
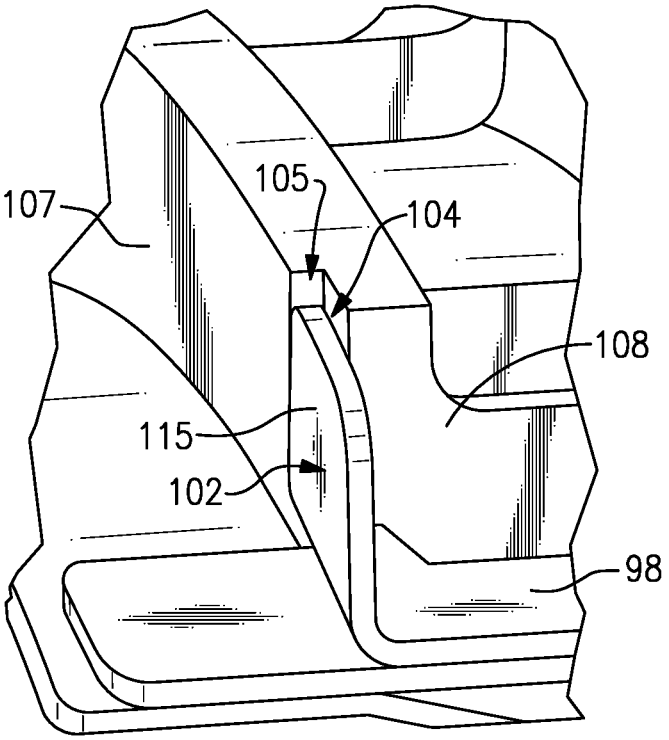
FIG. 5 illustrates a portion of the example seal assembly.

As shown in FIG. 5, with continued reference to FIG. 4, in the example, an axial indentation 105 is provided in the flange 108, such that a forward surface 104 of the indentation 105 is axially aft of the forwardmost surface 107 of the flange. The leg 102 is received against the forward surface 104 of the indentation 105. In the example, the forward surface 115 of the leg 102 does not contact the seal segment 72.

Figure 6:
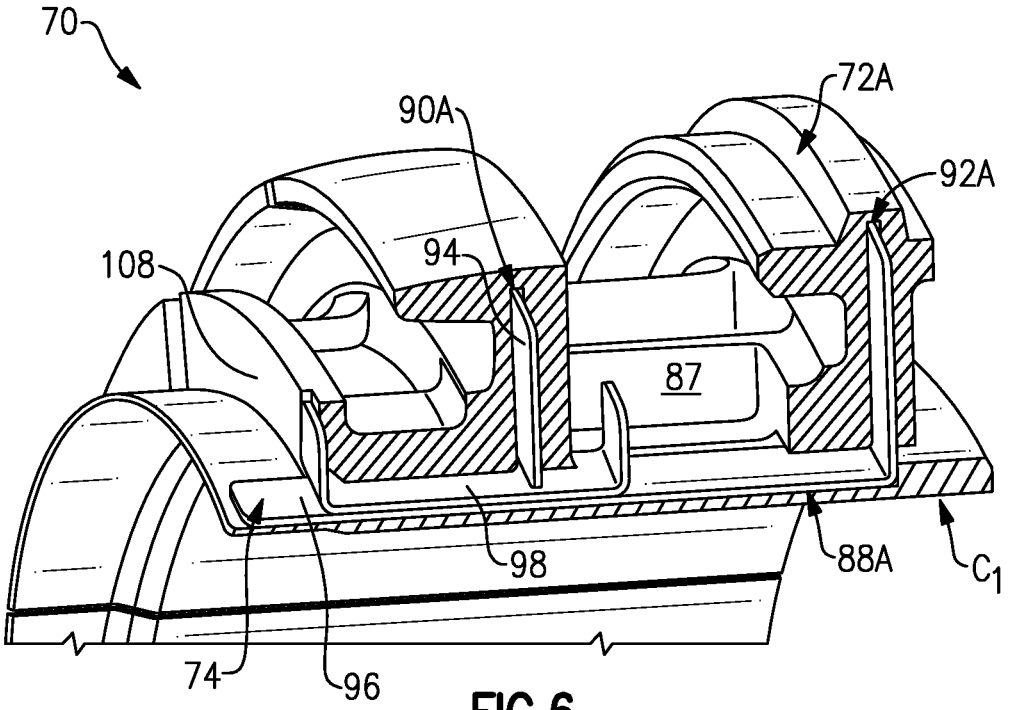
FIG. 6 illustrates the example seal assembly.
Figure 7:
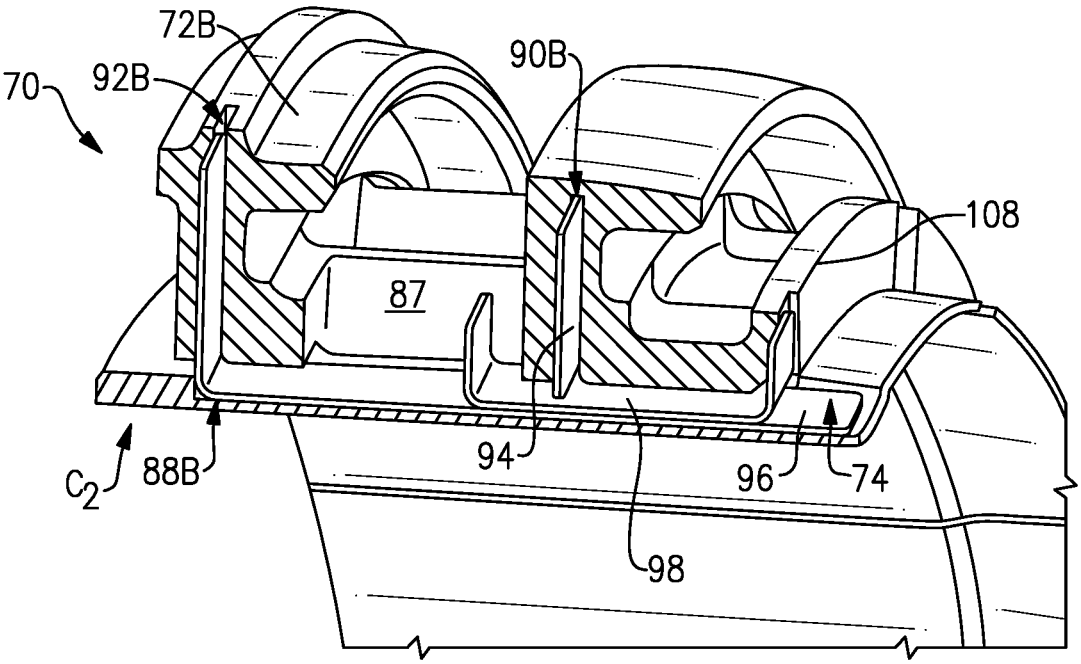
FIG. 7 illustrates the example seal assembly.
Figure 8:
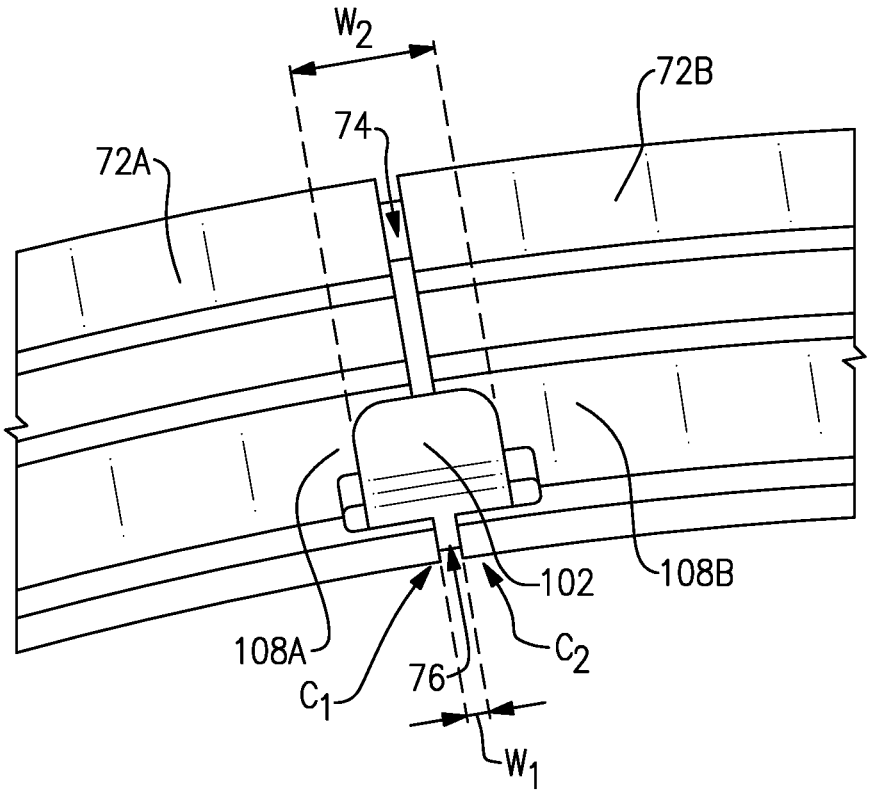
FIG. 8 illustrates a front view of a portion of the example seal assembly.

As illustrated in FIGS. 6-8, the example feather seal assembly 74 is received in slots at circumferential ends C1, C2 of two adjacent seal segments 72A, 72B. FIG. 6 illustrates the feather seal assembly 74 received at the circumferential end C1 of the seal segment 72A. The adjacent seal segment 72B (see FIG. 7) is removed for ease of viewing. As shown, slots 88A, 90A, 92A are provided at the circumferential end C1 of the segment 72A. A middle feather seal 94 is received in the slot 90A, and an L-shaped feather seal 96 is received in the slot 88A and the slot 92A. A goalpost feather seal 98 is received in the slot 88A, against the flange 108 and within the cavity 87. Portions of each of middle feather seal 94, L-shaped feather seal 96 and goalpost feather seal 98 extend circumferentially beyond the end C1 and can be received in slots in a circumferential end C2 of an adjacent segment.

FIG. 7 illustrates the feather seal assembly 74 received in the circumferential end C2 of the seal segment 72B. The adjacent seal segment 72A (see FIG. 6) is removed for ease of viewing. As shown, slots 88B, 90B, 92B are provided at the circumferential end C2 of the segment 72B. With reference to FIG. 6, at least part of the portions of the feather seal assembly 74 that extend beyond the circumferential end C1 of segment 72A are received in the slots 88B, 90B, 92B at circumferential end C2 of seal segment 72B. The middle feather seal 94 is received in the slot 90B, and the L-shaped feather seal 96 is received in the slot 88B and the slot 92B. The goalpost feather seal 98 is received in the slots 88B, against the flange 108 and within the cavity 87. Portions of each of middle feather seal 94, L-shaped feather seal 96 and goalpost feather seal 98 extend circumferentially beyond the end C2 and can be received in slots in a circumferential end C1 of an adjacent segment, such as seal segment 72A shown in FIG. 6.

FIG. 8 illustrates an axial view of the example feather seal assembly 74 received in circumferential ends C1, C2 of adjacent seal segments 72A, 72B. The first leg 102 is received against flanges 108A, 108B of adjacent seal segments 72. The feather seal assembly 74 extends across the gap 76, as the middle feather seal 94, L-shaped feather seal 96 and goalpost feather seal 98 are received in slots 88A/88B, 90A/90B, 92A/92B in each circumferential end C1, C2 (see FIGS. 6 and 7). Accordingly, the feather seal assembly 74 provides sealing in the gap 76 between adjacent segments 72A, 72B. In some examples, the gap 76 has a width w1 between 0.020 and 0.030 inches (0.508 mm and 0.762 mm). One or more of the components of the feather seal assembly 74 may have a width w2 between 0.100 inches and 0.200 inches (2.54 mm and 5.08 mm).

Figure 9:
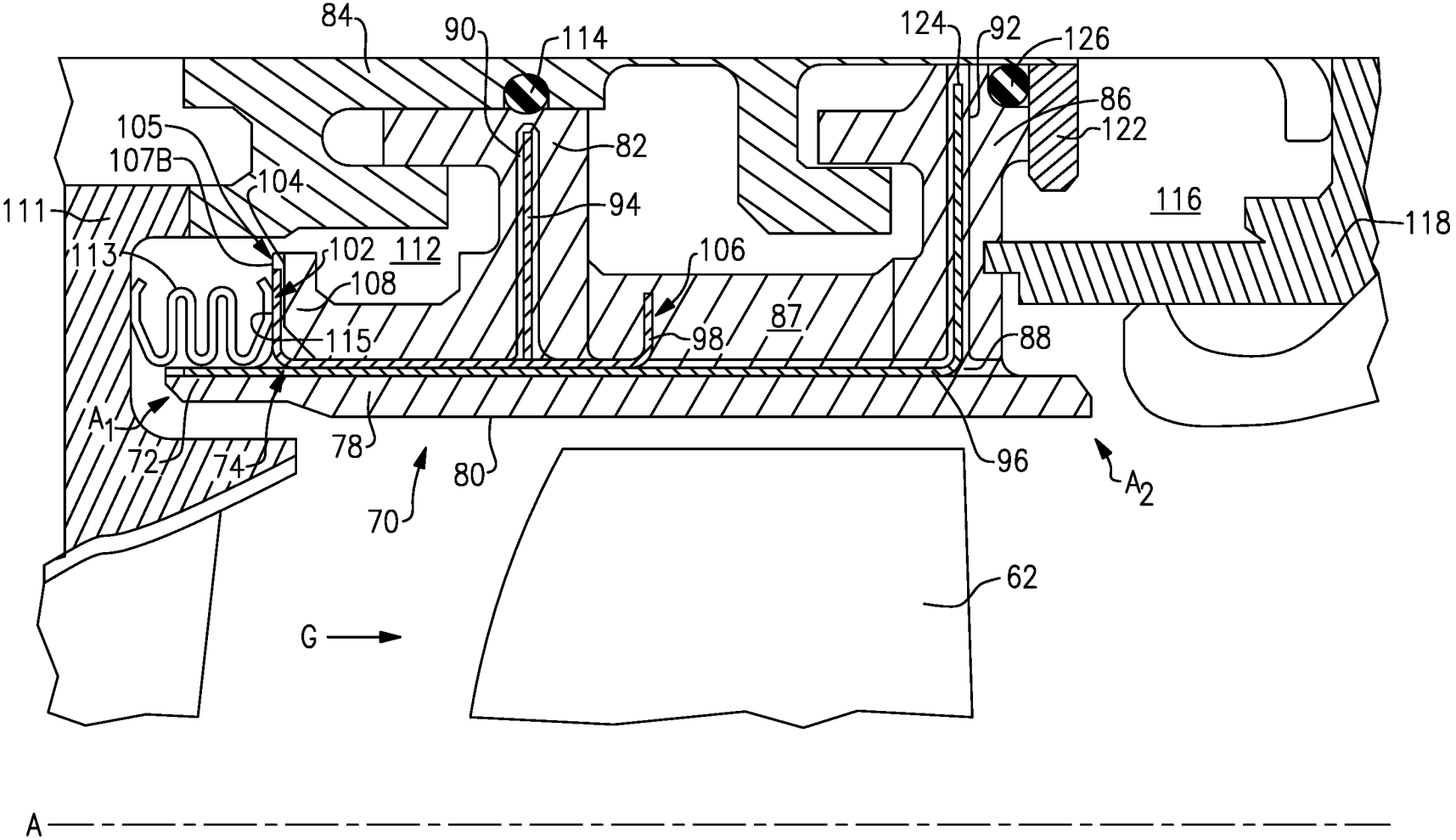
FIG. 9 illustrates a cross sectional view of the example seal assembly.

As illustrated in FIG. 9, the seal assembly 70 may provide a forward cavity 112 axially forward of the hook 82 from the central cavity 87. The forward cavity 112 is bound by the hook 82, the support 84, a stator rail 111 and a fully annular gasket 113 received between the stator rail 111 and the flange 108. With the leg 102 received against a forward surface 104 in an indentation 105, the gasket 113 is received against the forward surface 107 of the flange 108 and the forward surface 115 of the leg 102 for fully annular sealing. The forward cavity 112 may be pressurized to a different pressure than the center cavity 87. The middle feather seal 94 and an annularly extending rope seal 114 between the hook 82 and the support 84 provide an axial fluid barrier between the forward cavity 112 and the center cavity 87 at the gaps 76 (see FIG. 8), such that the differing pressures can be achieved. The radially inner edge of the middle feather seal 94 abuts the goalpost feather seal 98. A portion of the L-shaped feather seal received in the slot 88 is radially inward of and axially aligned with the gasket 113.

The L-shaped feather seal 96 and the goalpost feather seal 98 within the slot 88 provide a radial fluid barrier between the cavities 87, 112 and the gas path G. The portion of the L-shaped feather seal 96 within the slot 92 provides an axial fluid barrier between the central cavity 87 and an aft cavity 116 provided at least partially by a brush seal 118 and the hook 86. In the example, the aft cavity 116 is pressurized to a different pressure than the central cavity 87. In the example, an annularly extending second rope seal 126 between the hook 86 and the support 84 and a fully annular ring seal 122 aft of the hook 86 are provided for additional sealing between the central cavity 87 and the aft cavity 116. The rope seal 126 and the ring seal 122 are aft of the L-shaped feather seal 96. In the example, the rope seal 114 and the rope seal 126 extend fully annularly, each having two ends that meet to complete an annular seal. In one example, portions of one or both of the second rope seal 126 and the ring seal 122 are radially inward of the radially outer edge 124 of the L-shaped feather seal 96 to provide fluid separation between the aft cavity 116 and the central cavity 87. The seal assembly 70 provides sealing between the gas path G and cavities 87, 112, 116 opposite the gaspath and sealing between the respective cavities 87, 112, 116.

Figure 10:
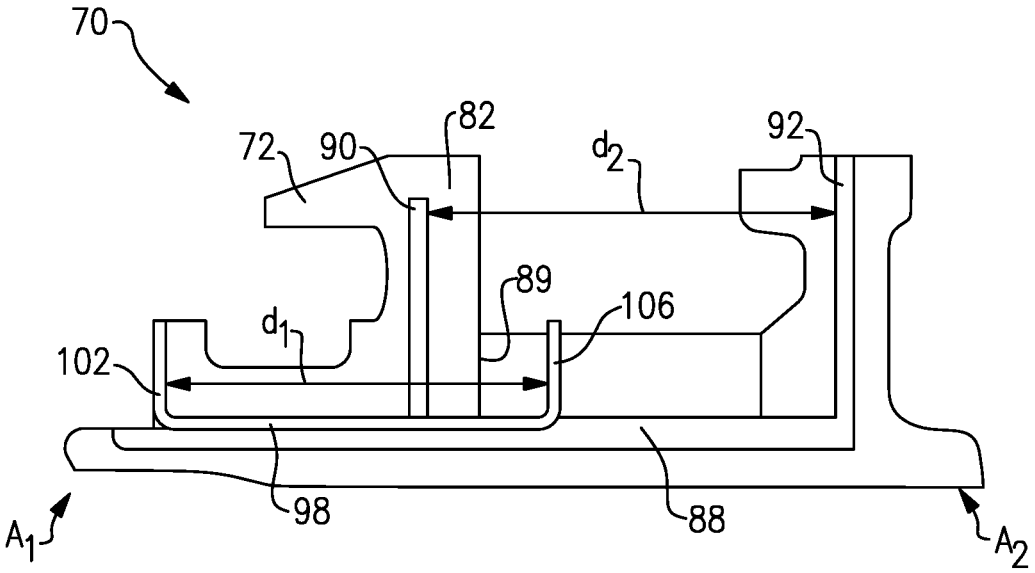
FIG. 10 illustrates an example goalpost feather seal and an example seal segment.

FIG. 10 illustrates an example segment 72 with only the goalpost feather seal 98 of the feather seal assembly 74 shown. The first leg 102 and second leg 106 are a distance d1 apart. The slot 90 and the slot 92 are a distance d2 apart. In the example, the distance d1 is different from the distance d2. In one example, the distance d1 is less than the distance d2. In the example, the distance d1 is 80-97 percent of the distance d2. In another non-limiting example, the distance d1 is 87-97 percent of the distance d2. The difference between distance d1 and distance d2 provides mistake-proofing for the seal assembly 70. If the distance d1 is different from the distance d2, the legs 102, 106 cannot be mistakenly assembled into the slots 90 and 92. Moreover, by providing two legs 102, 106, as opposed to the goalpost feather seal 98 being L-shaped, the goalpost feather seal 98 cannot be mistakenly assembled into the slot 88 and the slot 92, or onto the slot 88 and the slot 90. The goalpost feather seal 98 can therefore only be received in its proper position. The leg 106 also prevents the goalpost feather seal 98 from moving too far toward the axial end A1, such as during shipping of the assembly 70, or at a disengagement of the gasket 113 (See FIG. 9), by eventually contacting the aft surface 89 of the first hook 82. The goalpost feather seal 98 provides assembly mistake-proofing and added retention of the feather seal assembly 74.

One of ordinary skill in this art would understand that the above-described embodiments are exemplary and non-limiting. That is, modifications of this disclosure would come within the scope of the claims. Accordingly, the following claims should be studied to determine their true scope and content.

What is claimed is:

1. A seal assembly for a gas turbine engine, comprising:
- a seal segment including
  - a blade-sealing portion providing an elongated slot,
  - a flange extending from the blade-sealing portion, and
  - a hook extending from the blade-sealing portion and spaced from the flange, the hook having a surface that at least partially provides a cavity;
- a feather seal having an elongated portion and first and second legs extending from the elongated portion, wherein the first leg abuts the flange, the second leg is disposed in the cavity, and the elongated portion is disposed in the elongated slot; and
- a middle feather seal, wherein the hook provides a hook slot extending from the elongated slot, and the middle feather seal is received in the hook slot, and an end of the middle feather seal abuts the elongated portion.

2. The seal assembly as recited in claim 1, wherein the feather seal has a goalpost shaped cross section.

3. The seal assembly as recited in claim 1, further comprising a gasket received against the first leg.

4. The seal assembly as recited in claim 1, wherein the seal segment includes a second hook providing a second hook slot.

5. The seal assembly as recited in claim 4, comprising an L-shaped feather seal received in the second hook slot and the elongated slot.

6. The seal assembly as recited in claim 5, further comprising a gasket received against the first leg.

7. A seal assembly for a gas turbine engine, comprising:
- a seal segment including
  - a blade-sealing portion providing an elongated slot,
  - a flange extending from the blade-sealing portion, and
  - a hook extending from the blade-sealing portion and spaced from the flange, the hook having a surface that at least partially provides a cavity;
  - a second hook spaced from the first hook and at least partially providing the cavity, wherein the first hook provides a first hook slot extending from the elongated slot, and the second hook provides a second hook slot extending from the elongated slot;
- a feather seal having an elongated portion and first and second legs extending from the elongated portion, wherein the first leg abuts the flange, the second leg is disposed in the cavity, and the elongated portion is disposed in the elongated slot;
- a middle feather seal received in the first hook slot; and
- an L-shaped feather seal received in the second hook slot and the elongated slot.

8. The seal assembly as recited in claim 7, wherein the distance between the first and second legs is different from the distance between the first hook slot and the second hook slot.

9. The seal assembly as recited in claim 7, wherein the distance between the first and second legs is less than the distance between the first hook slot and the second hook slot.

10. The seal assembly as recited in claim 7, wherein an end of the middle feather seal abuts the elongated portion.

11. A gas turbine engine, comprising:
- a turbine section positioned about an engine central longitudinal axis; and
- a seal assembly of the turbine section including
  - a seal segment including
    - a blade-sealing portion providing an axially elongated slot with respect to the engine central longitudinal axis,
    - a flange extending radially outward from the blade-sealing portion, and
    - a first hook extending radially outward from the blade-sealing portion and axially aft of the flange, the hook having a surface that at least partially provides a cavity,
    - a second hook axially aft of the first hook and at least partially providing the cavity, wherein the first hook provides a first hook slot extending radially outward from the elongated slot, and the second hook provides a second hook slot extending radially outward from the elongated slot, and
  - a feather seal having an elongated portion and first and second legs extending from the elongated portion, wherein the first leg abuts the flange, the second leg is disposed in the cavity, and the elongated portion is disposed in the elongated slot, a middle feather seal received in the first hook slot, and an L-shaped feather seal received in the second hook slot and the elongated slot.

12. The gas turbine engine as recited in claim 11, wherein the axial distance between the first and second legs is different from the axial distance between the first hook slot and the second hook slot.

13. The gas turbine engine as recited in claim 11, wherein the axial distance between the first and second legs is less than the axial distance between the first hook slot and the second hook slot.

14. The gas turbine engine as recited in claim 11, further comprising:

a rotor section, wherein the seal assembly is radially outward of and axially aligned with the rotor section; and a stator section axially spaced from the rotor section.

15. The gas turbine engine as recited in claim 14, comprising a gasket received against a forward surface of the flange and a forward surface of the first leg.

16. The gas turbine engine as recited in claim 15, wherein the stator section includes a stator rail, and the gasket is received between the stator rail and the flange.

17. The gas turbine engine as recited in claim 11, wherein an end of the middle feather seal abuts the elongated portion.

18. The gas turbine engine as recited in claim 17, further comprising a gasket received against the first leg.

19. A method of assembling a seal assembly for a gas turbine engine, comprising:

providing a plurality of circumferentially spaced seal segments radially outward of a rotor with respect to an engine centerline axis, each seal segment including a blade-sealing portion providing an elongated slot, a flange extending from the blade-sealing portion, and a first hook extending from the blade-sealing portion and spaced from the flange, the hook having a surface that at least partially provides a cavity, and the hook including a hook slot;

inserting a feather seal assembly into circumferentially adjacent ones of the plurality of seal segments, the feather seal assembly including a feather seal having an elongated portion and first and second legs extending from the elongated portion, such that the first leg abuts the flange of each of the adjacent ones of the plurality of seal segments, the second leg is disposed in the cavity of each of the adjacent ones of the plurality of seal segments, and the elongated portion is disposed in the elongated slot of each of the adjacent ones of the plurality of seal segments; and inserting a middle feather seal into the hook slot, such that an end of the middle feather seal abuts the elongated portion.

20. The method as recited in claim 19, wherein each seal segment includes a second hook including a second hook slot, the method comprising inserting an L-shaped feather seal into the second hook slot and the elongated slot.

* * * * *